United States Patent [19]

Baltschun

[11] 4,202,433

[45] May 13, 1980

[54] TOOL PROTECTION ARRANGEMENT FOR HYDRAULIC PRESSES

[75] Inventor: Horst Baltschun, Rülzheim, Fed. Rep. of Germany

[73] Assignee: SMG Süddeutsche Maschinenbau-Gesellschaft mbH, Fed. Rep. of Germany

[21] Appl. No.: 888,749

[22] Filed: Mar. 21, 1978

[30] Foreign Application Priority Data

Mar. 22, 1977 [DE] Fed. Rep. of Germany ..... 2712472

[51] Int. Cl.[2] ..... B26D 7/24

[52] U.S. Cl. ..... 192/129 A; 83/58; 83/61; 83/554; 83/617; 91/356; 100/53; 192/134

[58] Field of Search ..... 192/129 R, 134, 129 A, 192/129 B; 83/58, 61-63, 554, 617; 91/356; 100/53

[56] References Cited

U.S. PATENT DOCUMENTS

| | | | |
|---|---|---|---|
| 1,600,256 | 9/1926 | Stoll | 83/58 X |
| 3,543,621 | 12/1970 | Weiland | 83/61 |
| 3,991,639 | 11/1976 | Pfeifer | 83/61 |
| 4,006,655 | 2/1977 | Maurer | 83/63 |
| 4,010,679 | 3/1977 | Dybel | 192/129 A X |

*Primary Examiner*—Frank T. Yost
*Attorney, Agent, or Firm*—Craig & Antonelli

[57] ABSTRACT

An arrangement for protecting tools in a hydraulic press against overloading if a foreign object or body is present in a tool space of the hydraulic press. A displacement or travel switch monitors at least a portion of a path of movement of a press ram with a control member providing an output signal during a predetermined movement of the press ram. A control circuit evaluates a sequence of the output signals of the displacement or travel switch and the control member in such a manner that a fault signal is formed when the additional switching device provides an output signal prior to an output signal of the displacement or travel switch. The control member is arranged in a path of force of at least one component of the hydraulic press and is constructed as a signal transducer operating virtually stationarily as a function of pressure.

10 Claims, 3 Drawing Figures

TOOL PROTECTION ARRANGEMENT FOR HYDRAULIC PRESSES

The present invention relates to a protection arrangement and, more particularly, to an arrangement for protecting a tool set in a hydraulic press against overloading if an object or foreign body is situated in a tool space of the hydraulic press.

In U.S. Pat. No. 3,991,639, a tool protection arrangement is proposed wherein a control member is provided which responds to a movement of the press ram. The control member is constructed as a travel switch or a switch which is responsive to a relative movement of two components of the press. The travel switch is arranged in such a way that relative movement between a movable driven piston of at least one high-speed cylinder piston unit and the press ram is sensed. For the purpose of sensing the relative movements between the piston rod of the piston of the at least one high-speed cylinder piston unit and the press ram, the piston rod carries at an end opposite the piston of the high-speed cylinder piston unit a sensing piston which is movably guided in a sensing cylinder in the ram subject to a pressure medium. Between the ram and a collar on the piston rod, there is formed a sensing gap, the compression of which is indicated by the travel switch. As a result of the adjustment of the pressure of the pressure medium supplied to the sensing cylinder to a suitable value, the proposed tool protection arrangement operates so that the sensing gap remains open so long as the at least one high-speed cylinder piston unit moves the ram in the work stroke direction without having to overcome a resistance to movement which exceeds the normal value during an idle stroke. When the sensing gap is closed, the travel switch responds as soon as a resistance to movement of the press ram exceeds the normal value during an idle stroke.

By virtue of the interposition of a sensing piston movable relative to the press ram, there may occur some reduced precision in a guidance of a tool fixed to the press ram. Moreover, some difficulties may be encountered in effecting control where an object is present in the tool space since the press ram with the tool fixed thereto must, first of all, be accelerated relative to the piston rod of the piston of the at least one high-speed cylinder piston unit which is continuing its movement, that is, must be absolutely decelerated, before a relative movement between the ram press and the piston rod, that is, a closing of the sensing gap, can be sensed by the travel switch. Furthermore, due to the substantial masses involved in hydraulic press structures, some delays may be experienced in the response of the travel switch. Additionally, in spite of the presence of a foreign body or object in the tool space of the press, considerable forces may act upon the tools.

In Swiss Pat. No. 490,963, a tool protection device is proposed wherein a switching element, responsive to a movement of a ram, is in the form of a displacement switch, that is, a switch responsive to a relative movement of two parts of a press with respect to one another. In the proposed device, the additional displacement switch is so disposed that it scans relative movements between the driven ram and a tool carrier plate which preceeds the ram in a direction of the working stroke. The tool carrier plate is guided for relative movement and is usually referred to as a "scanning table."

A disadvantage of this proposed protection arrangement resides in the fact that there is a reduction in the accuracy of the guidance of a tool fastened on the tool carrier plate, which guidance is based on the interposition of the tool carrier plate which is movable relative to the ram.

In commonly-assigned U.S. patent application Ser. No. 854,642, a tool protection arrangement for tools of a hydraulic press is proposed wherein a displacement switch means is provided for monitoring a portion of a movement path of a press ram and for providing an output signal indicative of such movement with a further switching means being provided which responds or provides an output signal of ram movement. A control circuit means is operatively connected to both switching means for evaluating a sequence of the output signals of the switching means in such a manner that a fault signal is formed in the event an output signal is received from the further switching means prior to an output signal from the displacement switch means. The further switching means may be in the form of a pressure limiting valve and/or a flow monitor, and the pressure limiting valve may be operatively connected with a hydraulically-operated directional valve.

The aim underlying the present invention essentially resides in providing a tool protection arrangement for hydraulic presses in which a control member is provided which is capable of controlling the movement of the press ram in response to the smallest possible deceleration occasioned by a presence of a foreign body or object in a tool space of the press.

According to advantageous features of the present invention, a press ram, movable in a work stroke direction by at least one fast stroke or high-speed cylinder piston unit and at least one work stroke pressure unit, has its movement monitored by a travel or displacement switch over at least a portion of a work stroke with a control member being arranged in a path of force of components of the hydraulic press. The control member is capable of providing a response or output signal during a movement of the press ram in a work stroke direction in the event an object or foreign body is located in a tool space of the hydraulic press. A control circuit is operatively connected with the hydraulic press, the travel or displacement switch and the control member for receiving signals therefrom and evaluating the sequence of the receipt of the signals from the travel or displacement switch and the control member so as to formulate a fault signal if the control member provides an output signal prior to an output signal from the displacement or travel switch.

According to the present invention, the control member is constructed as a signal transducer which operates virtually stationarily as a function of the operating pressure occurring during the movement of the press ram.

The displacement switch, in accordance with the present invention, is so arranged and adjusted so as to respond or provide an output signal when the tool moved by the ram has moved toward the other tool until its distance from the other tool corresponds or substantially corresponds to the predetermined thickness of the workpiece which is to be processed. A fault signal, by which the continuation of the movement of the press ram in a work stroke direction is suppressed, can then be produced if there is present in the tool space an obstacle in the form of, for example, a second unprocessed workpiece of a predetermined thickness, a workpiece processed in a preceding work stroke, accrued waste material and/or other foreign bodies.

The same action, namely, the generation of a fault signal, also takes place in accordance with the present invention if, before the position monitored by the displacement or travel switch is reached, the resistance of the ram increases, for example, as a result of a fault in the guiding of the press ram to such an extent that an increase of resistance to movement by the ram simulates the presence of an object in a tool space of the hydraulic press.

According to a particularly advantageous feature of the present invention, the signal transducer operating virtually stationarily as a function of the pressure is arranged in the path of force of a high-speed or fast stroke cylinder piston unit. Due to the high speed action of the high-speed or fast stroke cylinder piston units, such units generally exhibit comparatively small effective pressure medium actuated surfaces so that only comparatively weak forces can act on the tools if an object or foreign body is present in the tool space of the hydraulic press.

According to the present invention, the signal transducer may be constructed as a piezo-electric pressure recorder with silicon cell, a piezo-electric manometer cartridge, or as an extensometer strip arrangement. The arrangement or adjustment of the response pressure at which the signal transducer delivers an output or response signal can be adjusted in a conventional manner by the electrical circuitry of the signal transducer or by the provision of an adjustable electric threshold switch connected to the signal transducer.

Depending upon the design of the hydraulic press and the construction and arrangement of the at least one high-speed cylinder piston unit, the signal transducer may be disposed in the path of force of different components in different places of the hydraulic press. More particularly, it is possible according to the present invention to arrange the signal transducer between the press ram and the piston rod or the cylinder of the high-speed cylinder piston unit or between a portion of the press frame and the piston rod or the cylinder of the high-speed cylinder piston unit.

Accordingly, it is an object of the present invention to provide a protection arrangement for working tools of hydraulic presses which avoids by simple means drawbacks and disadvantages encountered in the prior art.

Another object of the present invention resides in providing a protection arrangement for working tools of hydraulic presses wherein only comparatively weak forces can occur on the tools in the event a foreign body or other object is present in a tool space of the hydraulic press.

A further object of the present invention resides in providing a protection arrangement for working tools which functions reliably under all operating conditions.

An additional object of the present invention resides in providing a protection arrangement for working tools of hydraulic presses which is readily adjustable so as to permit adaptation to varying operating pressures of the hydraulic presses.

Yet another object of the present invention resides in providing a protection arrangement for working tools of hydraulic presses which is responsive to the smallest possible decelerations of components of the presses.

These and other objects, features and advantages of the present invention will become more apparent from the following description when taken in connection with the accompanying drawings which show, for the purposes of illustration only, two embodiments in accordance with the present invention, and wherein.

Figure 1:
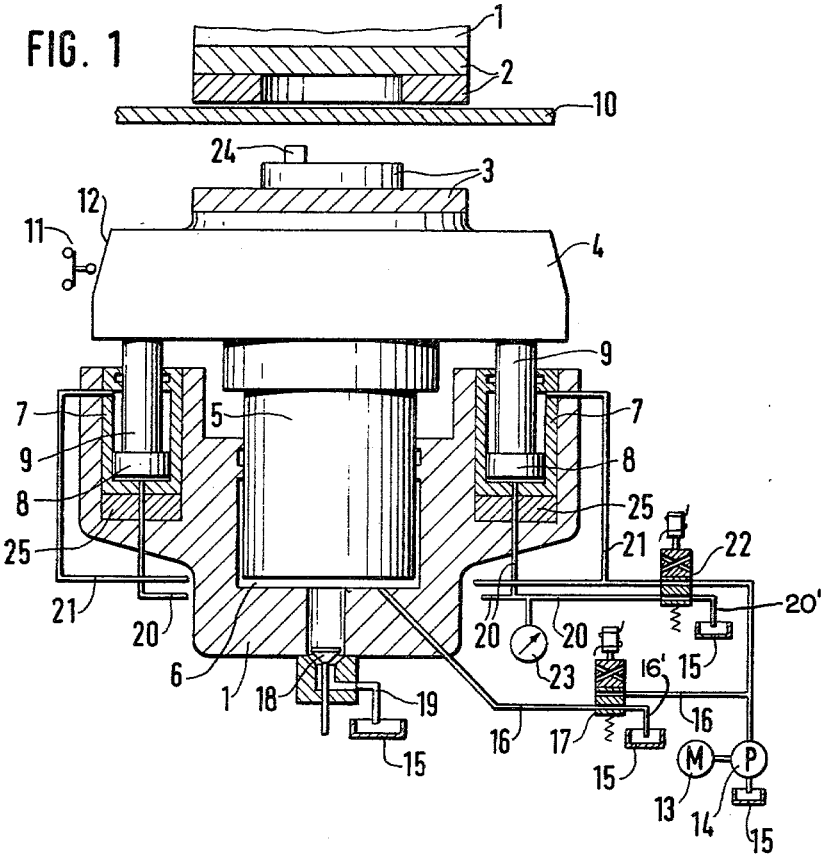
FIG. 1 is a cross-sectional, partially schematic view of a tool protection arrangement arranged at a hydraulic press in accordance with the present invention.

Referring now to the drawings wherein like reference numerals are used throughout the various views to designate like parts and, more particularly to FIG. 1, according to this figure, an upper tool 2 of a tool set is fastened on a top part of a frame 1 of a hydraulic press with a lower tool 3 of the tool set being fastened to a press ram 4 which is guided for vertical movement in a lower part of the frame 1. The press ram has an upward working stroke direction. Between the upper tool 2 and the lower tool 3 is disposed a strip 10 of material from which a workpiece is to be cut or punched. The reference numeral 24 designates an object or foreign body arranged in a tool space which gives rise to a fault signal. The object or foreign body 24 rests upon the lower tool 3.

A working stroke pressure unit is provided which includes a plunger or piston 5 and a pressure chamber 6 disposed in a lower part of the frame 1 with the plunger 5 acting centrally on an underside or lower face of the press ram 4. On each side of the work stroke pressure unit is arranged a high-speed or fast stroke cylinder piston unit with each unit including a cylinder 7 disposed in the lower part of the frame 1 and a piston 8. The high-speed or fast stroke cylinder piston units act, by means of piston rods 9, on the underside or lower face of the press ram 4.

A displacement or travel switch 11 is mounted to the frame 1 so as to be adjustable in a direction of movement of the press ram 4. The displacement switch 11 is actuated or responds to a movement of the press ram 4 by a switch arm or the like contacting a control surface 12 on the press ram 4 when the press ram 4 has reached a position in which the lower tool 3 is at a distance from the upper tool 2 which corresponds or substantially corresponds to a thickness of the strip 10 of material.

Pressure medium required to operate or actuate the work stroke pressure unit and the high-speed or fast stroke cylinder piston units is drawn from a pressure medium source which includes a pressure medium reservoir 15 and a pump 14 driven by a motor 13 with the pressure medium being pumped into a pressure medium supply system which includes a number of pipes or pressure medium conduits 16, 20, 21.

A solenoid valve 17 is arranged in one of the pressure medium conduits or pipes 16 which connect the pressure medium source to the pressure medium chamber 6. The pressure medium chamber 6 is in communication with the pressure medium reservoir 15 by way of a one-way or non-return valve 18 and a suction pipe 19. The other pressure medium conduits or pipes 20, 21 establish communication with the upper and lower cylinder spaces in the cylinders 7 by way of an additional solenoid valve 22. A manometer or pressure gauge 23 is connected to the pressure medium conduit or pipe 20.

Discharge pipes 20', 16' communicate with the solenoid valves 22, 17 so as to permit discharge of the pressure medium from the pressure spaces through the solenoid valves 22, 17 to the pressure medium reservoir 15.

A signal transducer 25 is arranged in the lower part of the frame 1 beneath each of the cylinders 7 of the two high-speed or fast stroke cylinder piston units with the signal transducer 25 operating virtually stationarily as a function of the pressure exerted on the high-speed or fast stroke cylinder piston units.

Figure 2:
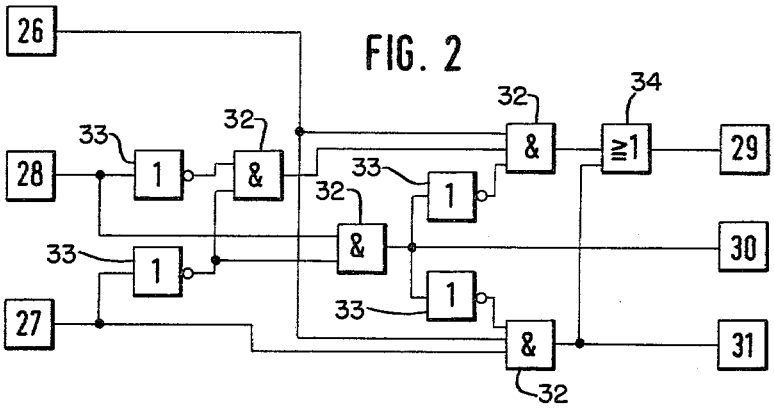
FIG. 2 is a logic control circuit for the tool protection arrangement in accordance with the present invention.

As shown in FIG. 2, a logic control circuit is provided which includes logic switching element such as AND gates 32, OR gates 34, and inverters 33 interposed between signal inputs 26, 27, 28 and signal outputs 29, 30, 31.

In FIG. 2, the input signal 26 represents a command signal from an automatic press control arrangement or a signal from a pushbutton operating the hydraulic press with either signal being generated when the press ram 4 is to be operated or moved in a work stroke direction. The input signal 27 represents a response or output signal of the displacement or travel switch 11. The input signal 28 represents a response or output signal of either one or both of the signal transducers 25.

The output signal 29 controls the operation of the solenoid valve 22 for effecting a change-over or switching of the solenoid valve 22 from the position shown in FIG. 1. The output signal 30 controls the operation of the solenoid valve 22 for effecting a changeover or switching of the solenoid valve 22 from a displaced position to the position illustrated in FIG. 1. The output signal 31 energizes the solenoid valve 17 for effecting a change-over or switching of the solenoid valve 17 from the position shown in FIG. 1.

Considering the logic circuit of FIG. 2, assuming that the input signals 26 and 27 are received by the logic circuit, output signals 29, 31 would displace the solenoid valves 17, 22 from the position shown in FIG. 1 so as to permit pressure medium to flow from the reservoir 15 through the conduits 16, 20 to the lower pressure spaces of the work stroke pressure unit and the high-speed or fast stroke cylinder piston units so that the press ram 4 is displaced in a working stroke direction. The displacement of the solenoid valve 22 also places the upper cylinder spaces of the high-speed or fast stroke cylinder piston units in communication with the pressure medium reservoir 15.

If a foreign body or object 24 is located in the tool space, the driving resistance is increased correspondingly so as to cause an increase in the pressure exerted on one or both of the signal transducers 25. Since there is an increase in the resistance prior to the actuation of the displacement or travel switch 11, one or both of the signal transducers 25 provide the input signal 28 to the logic circuit of FIG. 2 prior to the input signal 27 of the displacement or travel switch 11, thereby generating a fault signal so that the solenoid valve 22 is displaced to the illustrated position and communicates the lower pressure chambers of the high-speed or fast stroke cylinder piston units with the pressure medium reservoir 15.

Figure 3:
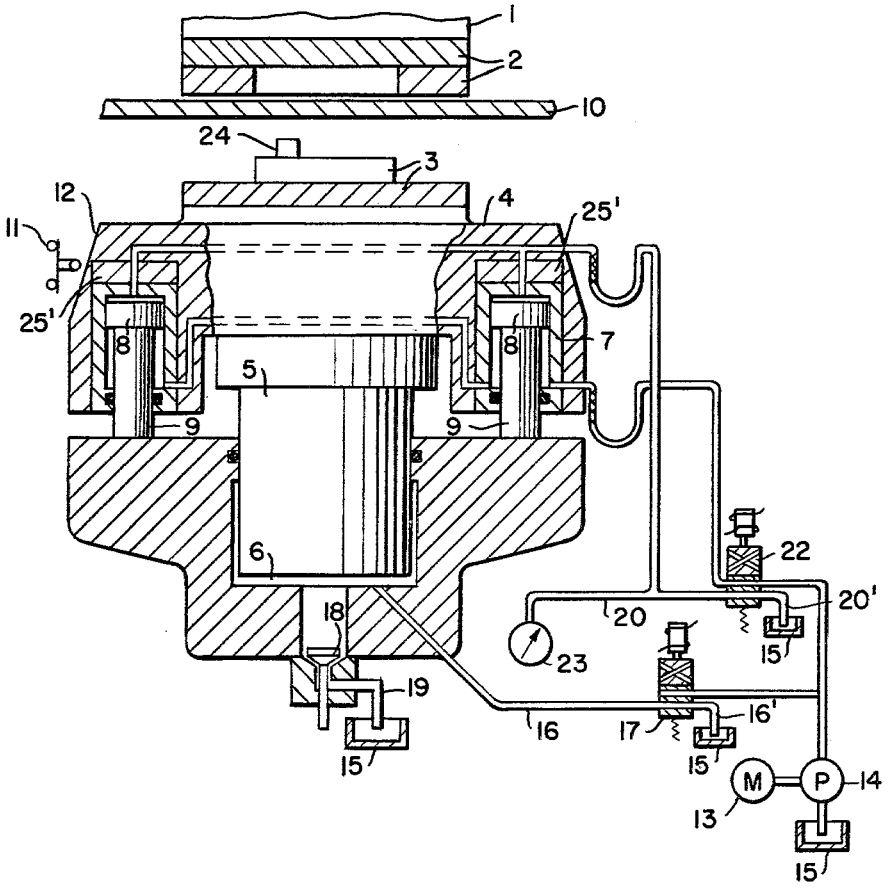
FIG. 3 is a cross-sectional, partially schematic view of a tool protection arrangement arranged in a hydraulic press in accordance with another embodiment of the present invention.

As shown in FIG. 3, a signal transducer 25' may be arranged between the cylinders 7 of the two high speed or fast strokes cylinder-piston units and the press ram 4.

The signal transducers 25 or 25' may be constructed as a piezo-electric pressure recorder with silicon cell, a piezo-electric manometer cartridge or an extensometer strip arrangement. As readily apparent, the function of the logic circuit of FIG. 2 determines the fundamental mode of operation of the tool protection arrangement in accordance with the present invention.

While I have shown and described only two embodiments in accordance with the present invention, it is understood that the same is not limited thereto, but is susceptible of numerous changes and modifications as would be known to a person skilled in the art to which it pertains, and I therefor do not wish to be restricted to the details shown and described hereinabove, but intend to cover all such changes and modifications as are encompassed by the scope of the appended claims.

I claim:

1. An arrangement for protecting a set of tools in a hydraulic press against an overloading by an object present in a tool space of the hydraulic press, the arrangement comprising a displacement switch means for monitoring at least a portion of a path of movement of a press ram in a working stroke direction and for providing an output signal indicative of a predetermined press ram movement, a control means for providing an output signal during a movement of the press ram, and a control circuit for evaluating a sequence of the output signals of the displacement switch means and the control means in such a manner that a false signal is generated when the control means provides an output signal prior to the output signal of the displacement switch means, characterized in that at least one fast stroke cylinder piston means and at least one working stroke pressure means are provided for causing a displacement of the press ram in the working stroke direction, the control means is arranged in a path of force of at least one component of the hydraulic press, the control means includes a signal transducer operating virtually stationarily as a function of pressure, and in that the signal transducer is arranged between at least two components of the hydraulic press with the two components being constituted by a cylinder of the high speed cylinder piston means and the press ram.

2. An arrangement for protecting a set of tools in a hydraulic press against an overloading by an object present in a tool space of the hydraulic press, the arrangement comprising a displacement switch means for monitoring at least a portion of a path of movement of a press ram in a working stroke direction and for providing an output signal indicative of a predetermined press ram movement, a control means for providing an output signal during a movement of the press ram, and a control circuit for evaluating a sequence of the output signals of the displacement switch means and the control means in such a manner that a false signal is generated when the control means provides an output signal prior to the output signal of the displacement switch means, characterized in that at least one fast stroke cylinder piston means and at least one working stroke pressure means are provided for causing a displacement of the press ram in the working stroke direction, the control means is arranged in a path of force of at least one component of the hydraulic press, the control means includes a signal transducer operating virtually stationarily as a function of pressure, the hydraulic press includes a lower frame member at which is arranged the at least one fast stroke cylinder piston means, the fast stroke cylinder piston means constituting the at least one component of the hydraulic press, and in that the signal transducer is arranged between a cylinder of the fast stroke cylinder piston means and a portion of the lower frame member of the hydraulic press.

3. An arrangement according to claim 2, characterized in that the signal transducer is a piezo-electric pressure recorder with a silicon cell.

4. An arrangement according to claim 2, characterized in that the signal transducer is a piezo-electric manometer cartridge.

5. An arrangement according to claim 2, characterized in that the signal transducer is an extensometer strip arrangement.

6. An arrangement, for protecting a set of tools in a hydraulic press against an overloading by an object present in a tool space of the hydraulic press, the arrangement comprising a displacement switch means for monitoring at least a portion of the path of movement of a press ram in a working stroke direction and for providing an output signal indicative of a predetermined press ram movement, a control means for providing an output signal during a movement of the press ram, and a control circuit for evaluating a sequence of the output signals of the displacement switch means and the control means in such a manner that a false signal is generated when the control means provides an output signal prior to the output signal of the displacement switch means, characterized in that at least one fast stroke cylinder piston means and at least one working stroke pressure means are provided for causing a displacement of the press ram in the working stroke direction, the control means is arranged in a path of force of at least one component of the hydraulic press, the control means includes a signal transducer operating virtually stationarily as a function of pressure, the hydraulic press includes a lower frame member, at least two fast stroke cylinder piston means are provided and arranged at the lower frame member, the control means is arranged in a path of force of at least two components of the hydraulic press with a fast stroke cylinder piston means constituting the at least two components of the hydraulic press, and in that at least one signal transducer is arranged between each of the respective fast stroke cylinder piston means and a portion of the lower frame member of the hydraulic press.

7. An arrangement according to claim 6, characterized in that each signal transducer is a piezo-electric pressure recorder with a silicon cell.

8. An arrangement according to claim 6, characterized in that each signal transducer is a piezo-electric manometer cartridge.

9. An arrangement according to claim 6, characterized in that each signal transducer is an extensometer strip arrangement.

10. An arrangement for protecting a set of tools in a hydraulic press against an overloading by an object present in a tool space of the hydraulic press, the arrangement comprising a displacement switch means for monitoring at least a portion of a path of movement of a press ram in working stroke direction and for providing an output signal indicative of a predetermined press ram movement, a control means for providing an output signal during a movement of the press ram, and a control circuit for evaluating a sequence of the output signals of the displacement switch means and the control means in such a manner that a false signal is generated when the control means provides an output signal prior to the output signal of the displacement switch means, characterized in that at least one fast stroke cylinder piston means and at least one working stroke pressure means are provided for causing a displacement of the press ram in the working stroke direction, the control means is arranged in a path of force of at least one component of the hydraulic press, the control means includes a signal transducer operating virtually stationarily as a function of pressure, and in that the signal transducer is arranged between at least two components of the hydraulic press with the two components being constituted by a frame member of the hydraulic press and a cylinder of the high-speed cylinder piston means.

* * * * *